US005490561A

United States Patent [19]

Cardoso-Neto et al.

[11] Patent Number: 5,490,561

[45] Date of Patent: Feb. 13, 1996

[54] PURGE WATER MANAGEMENT SYSTEM

[75] Inventors: Joao E. Cardoso-Neto, North Augusta; Daniel W. Williams, Aiken, both of S.C.

[73] Assignee: The United States as represented by the Department of Energy, Washington, D.C.

[21] Appl. No.: 398,537

[22] Filed: Mar. 6, 1995

[51] Int. Cl.[6] ..... E21B 49/08

[52] U.S. Cl. ..... 166/264; 166/369; 166/68; 166/105; 166/107; 175/59

[58] Field of Search ..... 166/264, 369, 166/68, 105, 107, 162, 168; 175/59

[56] References Cited

U.S. PATENT DOCUMENTS

| | | | |
|---|---|---|---|
| 2,210,546 | 8/1940 | Hassler | 166/264 |
| 2,781,663 | 2/1957 | Maly et al. | 166/264 X |
| 3,033,286 | 5/1962 | Fast et al. | 166/264 |
| 3,103,813 | 9/1963 | Bourne, Jr. et al. | 166/264 |
| 3,612,183 | 10/1971 | Shillander | 166/264 X |
| 4,669,554 | 6/1987 | Cordry | 175/59 |
| 4,690,216 | 9/1987 | Pritchard, Jr. | 175/59 X |
| 4,717,473 | 1/1988 | Burge et al. | 210/170 |
| 5,137,086 | 8/1992 | Stokley et al. | 166/264 |
| 5,147,561 | 9/1992 | Burge et al. | 210/747 |
| 5,176,207 | 1/1993 | Keller | 166/64 |
| 5,238,060 | 8/1993 | Niehaus et al. | 166/68 |
| 5,289,875 | 3/1994 | Stokley et al. | 166/264 |

*Primary Examiner*—Frank S. Tsay
*Attorney, Agent, or Firm*—Brian Tumm; Harold M. Dixon; William R. Moser

[57] ABSTRACT

A purge water management system for effectively eliminating the production of purge water when obtaining a groundwater sample from a monitoring well. In its preferred embodiment, the purge water management system comprises an expandable container, a transportation system, and a return system. The purge water management system is connected to a wellhead sampling configuration, typically permanently installed at the well site. A pump, positioned with the monitoring well, pumps groundwater through the transportation system into the expandable container, which expands in direct proportion with volume of groundwater introduced, usually three or four well volumes, yet prevents the groundwater from coming into contact with the oxygen in the air. After this quantity of groundwater has been removed from the well, a sample is taken from a sampling port, after which the groundwater in the expandable container can be returned to the monitoring well through the return system. The purge water management system prevents the purge water from coming in contact with the outside environment, especially oxygen, which might cause the constituents of the groundwater to oxidize. Therefore, by introducing the purge water back into the monitoring well, the necessity of dealing with the purge water as a hazardous waste under the Resource Conservation and Recovery Act is eliminated.

20 Claims, 2 Drawing Sheets

22
10
60
52
REL V
42
V
30
20
44
46
40
METER
V
32
50
54
48
14
V
74
70
12
18
16
80

22
10
30
52
REL V
60
42
V
20
44
46
40
METER
V
32
50
54
48
72
14
V
74
70
18
16
12
80

112
116
108
106
108
132
REC V
130
102
122
V
114
120
METER
V
110
14
126
124
128
104
18
12
80
16

22
10
206
220
40
30
20
212
214
V
46
200
208
V
92
48
210
204
72
50
V
74
202
70
14
18
80
12
16

PURGE WATER MANAGEMENT SYSTEM

BACKGROUND OF THE INVENTION

1. Field of the Invention

The present invention relates to an apparatus for effectively managing purge water when obtaining liquid samples from a well or the like. More particularly, the present invention relates to an apparatus for storing purge water when obtaining liquid samples from a well, and then returning the purge water into the well. The United States Government has rights in this invention pursuant to Contract No. DE-AC09- 89SR18035 between the U.S. Department of Energy and Westinghouse Savannah River Company.

2. Discussion of Background

Recent increases in public concerns for the environment have resulted in various government-imposed environmental laws, namely the Resource Conservation and Recovery Act (RCRA), and implementing regulations. Among such regulations are requirements relating to groundwater testing and monitoring. In response to these requirements, water quality analytical capabilities have been improved and water sampling equipment has been developed.

To obtain a groundwater sample from a monitoring well, it is necessary to purge the well by withdrawing three to four "well volumes" of water, and to stabilize certain indicator parameters. The water drawn from the well during the sampling process is called purge water, and is categorized as "investigation derived waste" (IDW) that must be managed as hazardous waste, in accordance with RCRA, when it contains constituents that are hazardous and/or radiological and exceed certain threshold limits. As a result of these regulations, the production of purge water requires its containerization and disposal as waste. The purge water, once in containers, must be transported to a disposal facility or treatment facility and handled respectively. Therefore, the amount of purge water created or produced is proportional to the expense required for its containerization, transportation, disposal, and/or treatment.

There are various devices that are used to reduce the amount of purge water created. U.S. Pat. No. 5,238,060 issued Aug. 24, 1993 to Niehaus, et al. discloses the use of an expandable bladder that seals the well into an upper and lower region. It is necessary, therefore, to purge only the lower region, before an effective sample may be taken. U.S. Pat. No. 5,147,561 issued Sep. 15, 1992, to Burge, et al.; U.S. Pat. No. 5,137,086 issued Aug. 11, 1992, to Stokely, et al.; and U.S. Pat. No. 4,717,473 issued Jan. 5, 1988, to Burge, et al., also disclose methods of dividing the well into a number of regions, thus reducing the amount of purge water produced or permitting multiple level sampling. However, these devices merely reduce the amount of purge water produced. Consequently, there is a need for an apparatus that can substantially eliminate the production of purge water, thereby avoiding the expense of its containerization, transportation, disposal, and/or treatment.

SUMMARY OF THE INVENTION

According to its major aspects and broadly stated, the present invention is a purge water management system to aid in sampling groundwater from a well. Typically, the wellhead has sampling hardware consisting of a riser pipe, a liquid level pipe, a flow meter, and a sampling port. The apparatus comprises an expandable container, possibly supported in a frame or housing. The expandable container is substantially air-free, or at least oxygen-free. Attached to an opening in the expandable container is a transportation system comprising a length of piping and at least one valve. The length of piping is connected to the sampling port of the wellhead, allowing fluid communication between the well and the interior of the expandable container. Also in fluid communication with the opening in the expandable container is a return system consisting of a length of piping and at least one valve. The return piping is in fluid communication with the liquid level pipe, permitting fluid to flow from the expandable container directly back into the well. Additionally, there is a pump, preferably submerged within the groundwater in the well, to pump the groundwater from the well into the expandable container. The pump is typically part of the wellhead sampling hardware, and thus is positioned within the well.

In operation, a quantity of groundwater sufficient to purge the well, usually three to four well volumes, is pumped into the expandable container which expands to meet the proportionate volume requirements. The flow meter, which is part of the wellhead sampling hardware, can be used to measure the volume of groundwater that has been removed from the well. Once the predetermined amount of groundwater, or purge water, is removed to the expandable container, a sample is taken through the sampling port, which can then be analyzed or monitored for contaminants. After sampling, the purge water is returned to the well via the return system. The purge water is returned by gravity through the return system or can be expedited with the use of a slight pressure on the outside of the bladder. Throughout the transportation process, the purge water is not exposed to the external environment, and in particular to oxygen, and thus, the constituents within the groundwater are not oxidized and thus, the characteristics of the groundwater are not changed significantly.

A major feature of the present invention is the expandable container that prevents exposure of the well water to oxygen. The advantage of this feature is that it allows the returning of the purge water to the well after sampling has occurred. By returning the three to four well volumes back into the well, the purge water does not need to be handled as a hazardous waste under RCRA. Therefore, this reduces the need for containerization, transportation, disposal, and/or treatment of the purge water.

Still another feature of the present invention is the use of an expandable container to avoid contact between the well water and oxygen. The expandable container will expand in direct proportion to the volume of the groundwater that is supplied, and therefore accommodates the volume of water from the well, liter for liter, regardless of the number of liters. Therefore, with the expandable container starting sufficiently air-free, as the purge water is introduced into the container it does not contact an oxygen source. The expandable container also provides an additional force from its resilience, other than gravity alone, to push the purge water through the return system.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
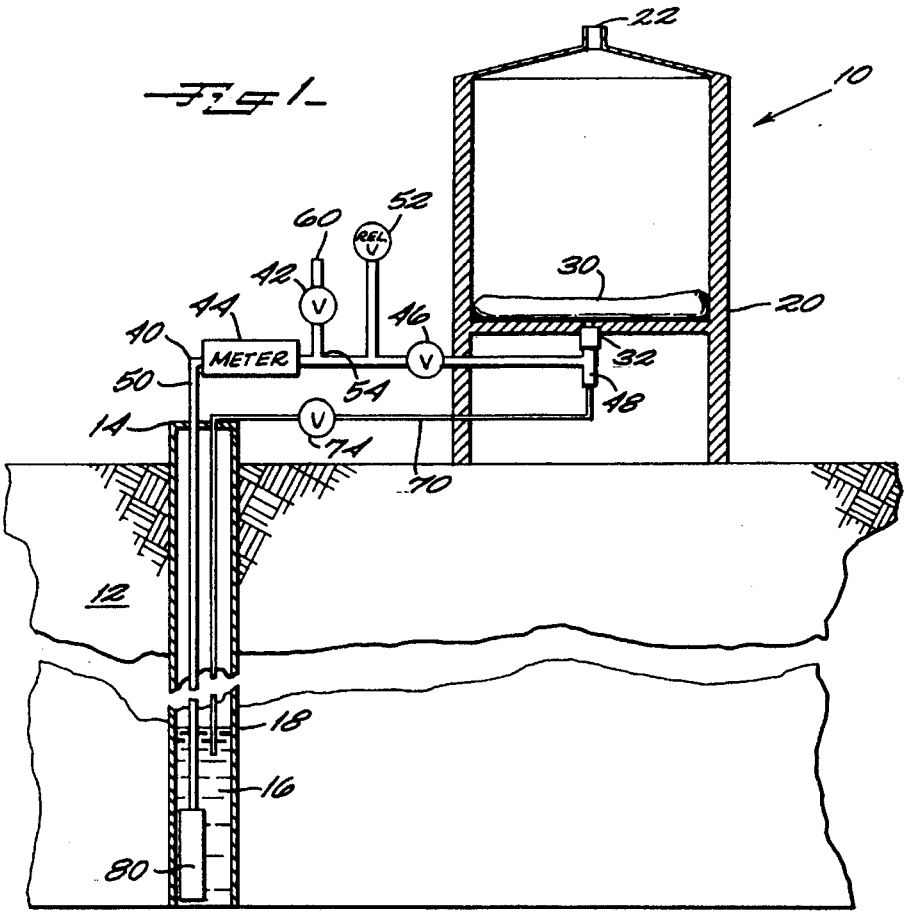
FIG. 1 is a partial cross-sectional view of a purge water management system according to a preferred embodiment of the present invention, showing a deflated bladder, as the expandable container, and a cross-sectional view of a monitoring well.

In the following description, similar components are referred to by the same reference numeral in order to simplify the understanding of the sequential aspect of the drawings.

Figure 2:
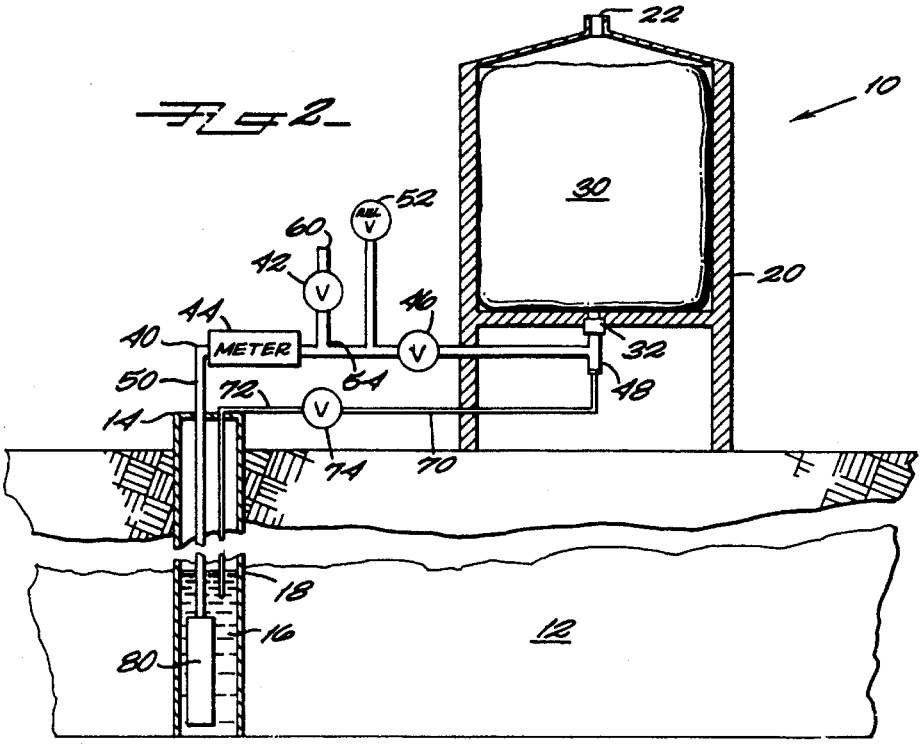
FIG. 2 is a partial cross-sectional view of a purge water management system according to a preferred embodiment of the present invention, showing an inflated bladder, as the expandable container, filled with purge water and a cross-sectional view of a monitoring well.
Figure 4:
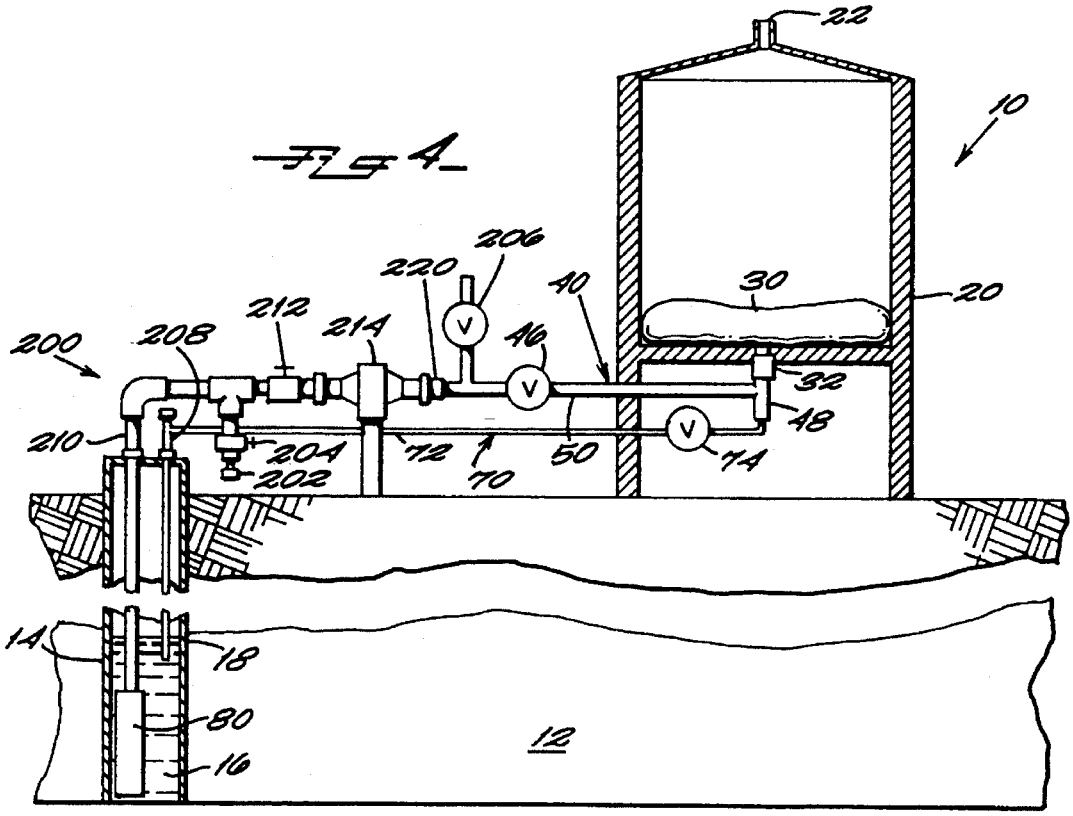
FIG. 4 is a partial cross-sectional view of a typical wellhead sampling hardware configuration and a partial cross-sectional view of a purge water management system connected according to the preferred embodiment of the present invention.

Referring now to FIG. 1 and FIG. 2, the purge water management system 10 in its preferred embodiment is an expandable container 30, a transportation system 40, and a return system 70, all for use with a monitoring well 14. Monitoring well 14 descends within the ground 12 until a supply of groundwater 16 is reached. Monitoring well 14 is typically a four (4) inch diameter well; however, the present invention could be adapted or modified to be used with a smaller or larger diameter well. Referring now to FIG. 4, monitoring well 14 is shown with a typical wellhead sampling hardware configuration 200. A riser pipe 210 extends the depth of well 14 to contact groundwater 16. Also extending the depth of well 14 is a liquid level pipe 208. Usually, riser pipe 210 is two (2) inches in diameter, while liquid level pipe 208 is three-fourths (¾) of an inch in diameter. FIG. 4 is illustrative of a typical wellhead system, as implemented, with purge water management system 10 connected. FIGS. 1 and 2 are partial cross sectional and partial schematic views of the preferred embodiment, and thus provide a better conceptual design of the preferred embodiment.

Referring specifically to FIGS. 1 and 2, expandable container 30 in its preferred embodiment is an inflatable bladder made of a stretchable, resilient oxygen-impermeable material. Expandable container 30 is designed to expand, from a first condition wherein it is substantially deflated and empty to a second condition where it contains at least one well volume, in direct proportion to the volume of fluid that is introduced into its interior. An opening 32 is located at the base of expandable container 30, and is preferably the only opening in expandable container 30 so as to better control access to the interior of container 30 and prevent oxygen exposure of groundwater 16. Furthermore, expandable container 30 is supported by a housing 20 that has an air vent 22 in, preferably, its top surface. Air vent 22 could be replaced by a valve stem, thus allowing the introduction of a slight pressure around expandable container 30 to expedite the evacuation of the purge water.

Transportation system 40 is designed to transport a quantity of groundwater 16 from within well 14 into expandable container 30. Pump 80 is submerged in well 14 below the water level 18, so that pump 80 can sufficiently pump a quantity of groundwater 16 through transportation system 40 into expandable container 30. A length of piping 50 extends from pump 80 up the depth of well 14 to the surface and then extends to a piping connection 48. Piping connection 48 is in fluid communication with opening 32. Within length of piping 50 is a piping junction 54, from which sampling port 60 extends. Sampling port 60 is designed so that a quantity of groundwater 16 may be taken and sampled. In its preferred embodiment, length of piping 50 is constructed from corrosion resistant, two (2) inch diameter piping.

There is a number of flow controlling devices within transportation system 40. Positioned between piping connection 48 and piping junction 54 is a transportation valve 46. A sampling valve 42 is positioned to control fluid flow through sampling port 60. There is an air relief valve 52 positioned between sampling port 60 and transportation valve 46. Typically, air relief valve 52 is designed to release air within transportation system 40 so that air is not introduced into expandable container 30. Additionally, a flow meter 44 is positioned within transportation system 40, so that the quantity of fluid pumped into expandable container may be regulated. In effect, flow meter 44 indicates to the operator or user that a sufficient amount of groundwater 16 has been pumped into expandable container 30 so that a sample may be taken.

Return system 70 is designed to return groundwater 16 that has been transported into expandable container 30 back into well 14. In fluid communication with piping connection 48 is a length of return piping 72 that extends from piping connection 48 to monitoring well 14. Return piping 72 ideally extends below waterline 18 of well 14 so that groundwater 16 is not aerated. Also within return piping 72 is a return valve 74 to provide flow control through return system 70.

In operation, pump 80 operates to pump a supply of groundwater 16 up length of piping 50, while transportation valve 46 is open, and sampling valve 42 and return valve 74 are closed. Groundwater 16 continues to flow through length of piping 50, through piping junction 54, and piping connection 48 into expandable container 30. During this process, air relief valve 52 releases air from transportation system 40. This process continues until the required amount of well volumes is removed to assure an accurate sampling. The "required amount of well volumes" when groundwater has recently migrated into a well, is at least one well volume, and preferably approximately three to four well volumes of groundwater. A "well volume" is the volume of groundwater in the well when the groundwater is at its normal height in the well. When groundwater is pumped from the well, more groundwater flows into holes through well screens into the well casing. The operator or user can monitor the quantity of fluid pumped into expandable container 30 through flow meter 44. Once a sufficient amount of groundwater 16 has been removed into expandable container 30, transportation valve 46 is closed (See FIG. 2.). Sampling valve 42 then is opened, allowing a sample of groundwater 16 to be taken through sampling port 60.

After a sufficient sample has been taken, pump 80 is cut off and sampling valve 42 is closed. To return groundwater 16 inside expandable container 30 back to well 14, return valve 74 is opened, thus allowing groundwater 16 to flow through return piping 72 and into well 14. Groundwater 16 flows back into well 14 due to the forces of gravity and the elastic and resilient nature of expandable container 30. The process may be repeated on this well or another well without having to deal with a quantity of purge water to containerize, treat, transport or otherwise dispose of.

In a separate embodiment, housing 20 may be pressurized. Therefore, as expandable container 30 expands, the pressure around container 30 increases. Thus, when groundwater 16 is released through return system 70, the pressure that has built up further aids in the returning of groundwater 16 back into well 14.

Different valving and piping sequences are possible and are known to those skilled in the art, so that groundwater sampling is still possible. The different valving sequences are within the bounds of this invention and thus, it is understood that these are included into the scope of this invention.

During the complete process it is preferable that groundwater 16 does not come into contact with the external environment. In other words, purge water management system 10 is a completely closed loop process. If an amount of purge water is produced, that is, groundwater 16 that must be removed from well 14 before an adequate sample may be taken, it is necessary under the Resource Conservation and Recovery Act (RCRA) to classify that purge water as a hazardous waste and therefore, treat it as such. Furthermore, if the purge water within expandable container 30 is to be reintroduced back into well 14, it must not have been oxidized. If oxidation of the constituents of the purge water occurs then, in effect, when the purge water is reintroduced to well 14 it would change the characteristics of groundwater 16 in well 14. Therefore, it is necessary that purge water management system 10 be closed loop, so that this result does not occur, as is disclosed in this reference.

Purge water management system's 10 basic concept is to avoid exposure to oxygen by storing the groundwater 16 in an expandable container so that all groundwater 16 that is removed from well 14 can be returned back into well 14 after a sample has been taken. In FIGS. 1 and 2 different components of purge water management system 10 may already be provided at each well site. Purge water management system 10 may be used and adapted to fit with the variety of existing wellhead configurations, without parting from the scope of the invention. Therefore, it is within the scope of this invention that some of the components may not be needed or may already be part of the wellhead, as in FIG. 4. FIG. 4 illustrates the likely implementation of purge water management system 10, with it being connected to wellhead sampling configuration 200 that is permanently installed into well 14.

Now referring to FIG. 4, the preferred embodiment in its likely mode of implementation comprises purge water management system 10 connected to wellhead sampling configuration 200. Wellhead sampling configuration 200 is used in conjunction with a typical four (4) inch monitoring well 14. There are two pipes that extend the depth of well 14, riser pipe 210 and liquid level pipe 208. A sampling port 202, with a sampling valve 204 positioned to control the fluid flow, is in fluid communication with riser pipe 210. Additional parts of wellhead sampling configuration 200 are a flow valve 212 and a flow meter 214. How valve 212 is designed to close fluid flow within wellhead sampling configuration 200, so that purge water management system 10 can be removed, while effectively sealing well 14 until its next monitoring. Flow meter 214 is designed to monitor the quantity of groundwater 16 that flows into purge water management system 10 and expandable container 30.

Purge water management system 10 and wellhead sampling configuration 200 are connected at point 220. Purge water management system 10, in FIG. 4, is similar in concept to the one described in FIGS. 1 and 2. Purge water management system 10 comprises a transportation system 40, a return system 70, and an expandable container 30. Expandable container 30 is contained within housing 20 with air vent 22 positioned in the top. Air vent 22 is designed to allow air to escape from housing 30 when expandable container 30 expands. However, as discussed previously, housing 20 could be pressurized so that groundwater 16 within expandable container 30 is forced back into well 14.

Transportation system 40, in its preferred implementation, comprises piping junction 48, length of piping 50, transportation valve 46, and an air relief valve 206. Return system 70, which begins at piping junction 48 consists essentially of return piping 72 which is in fluid communication with liquid level pipe 208. Also part of return system 70 is return valve 74 that controls groundwater 16 flowing back into well 14 from expandable container 30. The sampling of groundwater 16, operates substantially similar to that described in FIGS. 1 and 2.

In its implementation, purge water management system 10 could be permanently fixed at the monitoring site or could be contained within the back of a truck or other vehicle. With purge water management system 10 contained within a vehicle, the vehicle could move from site to site, effectively monitoring numerous wells, without producing any purge water that would need to be treated under the RCRA.

Figure 3:
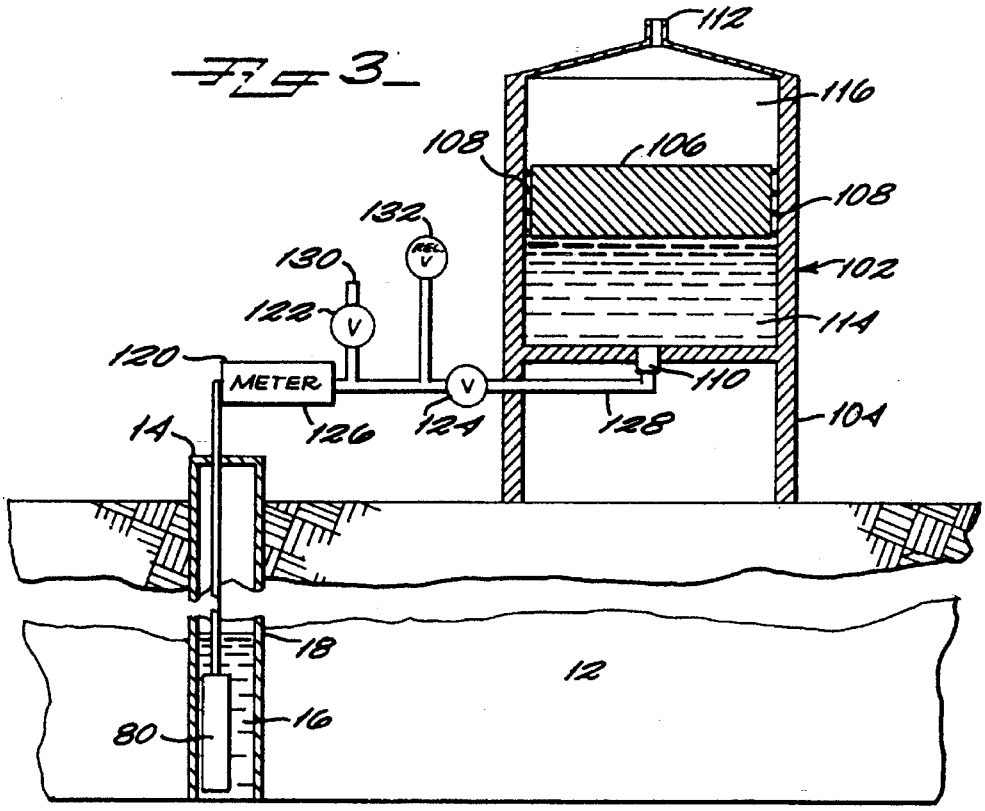
FIG. 3 is a partial cross-sectional view of a purge water management system according to a preferred embodiment of the present invention, showing a piston system, as the expandable container, and a single transporting and return system, and a cross-sectional view of a monitoring well.

In an alternative embodiment, referring now to FIG. 3, the purge water management system 10 comprises an expandable container system 102, a fluid transportation system 120, a pump 80, and a monitoring well 14. Monitoring well 14 is similar in nature as in the preferred embodiment and purge water management system 10 could also be adapted or modified to function with a different sized diameter well.

Expandable container system 102 comprises a housing 104, a piston 106, a sealing means 108, an opening 110, and an air vent 112. Piston 106 slides within housing 104, thus creating a fluid chamber 114, that is effectively oxygen-free. As piston 106 slides within housing 104, between a first condition where it has no interior volume and is essentially empty and a second condition where it contains groundwater, as sealing means 108, positioned on the perimeter of piston 106, prevents fluid exchanges between fluid chamber 114 and an upper chamber 116. Sealing means 108 can be any device known to those skilled in the art to provide an effective fluid seal between the outer surface of piston 106 and the inner surface of housing 104. When piston 106 slides within housing 104, outside air is either taken in or pushed out of upper chamber 116 through air vent 112. Air vent 112 prevents a pressure differential from occurring in upper chamber 116, which might effectively prevent the correct operation of piston 106. Additionally, there is a need to construct the interior of fluid chamber 114, piston 106, and any other component that comes into contact with groundwater 16 of a corrosion resistant material. It would be possible to merely coat the contacting surface of the components and still provide the corrosion resistance needed.

Positioned in the bottom of fluid chamber 114 is opening 110, where fluid is introduced into fluid chamber 114. As fluid is introduced, expandable container system 102 expands in direct proportion to the fluid, by the movement of piston 106, thus enlarging fluid chamber 114. In an alternate embodiment, there could be an actuating device attached to piston 106 to aid in its movement, or an initial pressure introduced into upper chamber 116 that would function as in the preferred embodiment.

In fluid communication with opening 110 is transportation system 120 that is designed to transport a quantity of groundwater 16 to and from well 14 and fluid chamber 114. Transportation system 120 is similar to the preferred embodiment and comprises a length of piping 128, a transportation valve 124, a flow meter 126, a sampling valve 122, and a sampling port 130. Pump 80, submerged below water line 18, pumps groundwater 16 through length of piping 128 to the surface, and then transports groundwater 16 to opening 110. Positioned between sampling port 130 and opening 110 is transportation valve 124. Sampling port 130, sampling valve 122, and air relief valve 132 are positioned and function substantially similar to their respective counterparts in FIGS. 1 and 2.

Purge water management system 10 accomplishes the same goals as in the preferred embodiment, that of decreasing production of purge water. In operation, transportation valve 124 is placed in the open position. Pump 80 pumps groundwater 16 up length of piping 128, through opening 110, and into fluid chamber 114. Pressure created by pump 80 forces groundwater into fluid chamber 114, raising piston 106 and expanding fluid chamber 114 to meet the volume of groundwater 16 that is introduced. As additional groundwater 16 is introduced into fluid chamber 114, air from upper chamber 116 is released through air vent 112, while sealing means 108 prevents the exchange of fluids between upper chamber 116 and fluid chamber 114.

Once a sufficient volume of groundwater 16 has been transported to fluid chamber 114, approximately three to four well volumes, transportation valve 124 is closed. How meter 126 is used to determine when a sufficient quantity of groundwater 16 has been purged and subsequently contained within fluid chamber 114. Sampling valve 122 is then opened so that a groundwater sample may be taken through sampling port 130. After the sampling is completed, pump 80 is stopped and sampling valve 122 is closed. Transportation valve 124 is then reopened, permitting groundwater 16 from fluid chamber 114 to return to well 14. Groundwater 16 flows from fluid chamber 114 because of the gravity of groundwater 16 and the additional force created by the weight of piston. Various valving sequences and piping (e.g., bypassing meter, sample port, etc.) are possible and are known to those skilled in the art, and thus it is understood that these variations are included within the scope of this invention.

Besides being used as a groundwater sampling device, the purge water management system 10 could have other uses. Along with sampling of various sizes of wells, system 10 could be used for any purpose where a quantity of fluid must be removed and then returned to its original location. Such sampling could be done in many manufacturing activities including a cleaning function, where the fluid of a container is removed so that the container may be cleaned, and then reintroduced into the container, without having the fluid come into contact with the outside environment.

It will be apparent to those skilled in the an that many changes and substitutions can be made to the preferred embodiment herein described without departing from the spirit and scope of the present invention as defined by the appended claims.

What is claimed is:

1. An apparatus for use in sampling groundwater from a well, said apparatus comprising:

an expandable container, said container having an opening, an interior, a first condition and a second condition, said interior having essentially no volume in said first condition, said container being expandable from said first condition to said second condition;

means for transporting said groundwater to said opening of said expandable container from said well, said container expanding from said first condition to said second condition on receipt of said groundwater; and means for returning said groundwater from said expandable container to said well.

2. The apparatus as recited in claim 1, wherein said expandable container is inflated by receipt of said groundwater, said container being deflated when in said first condition and filled with said groundwater when in said second condition.

3. The apparatus as recited in claim 1, wherein said expandable container is made of a stretchable, oxygen-impermeable material.

4. The apparatus as recited in claim 1, wherein said expandable container is a piston system that moves between said first condition and said second condition when said container receives said groundwater.

5. The apparatus as recited in claim 1, wherein said transporting means further comprises:

a first conduit;

first means for controlling said groundwater flowing through said conduit; and a pump for pumping said groundwater through said conduit.

6. The apparatus as recited in claim 1, wherein said transporting means further comprises a pump adapted to be submerged in said groundwater.

7. The apparatus as recited in claim 1, wherein said returning means further comprises;

a second conduit; and second means for controlling said groundwater flowing through said conduit.

8. The apparatus as recited in claim 1, further comprising a housing containing said expandable container, said housing having at least one air vent.

9. The apparatus as recited in claim 1, wherein said transporting means traps air and wherein said transporting means comprises means for releasing said trapped air from said transporting means.

10. Apparatus for sampling groundwater from a well having a volume, said apparatus comprising:

means for storing at least one volume of groundwater from said well so that said groundwater does not come into contact with oxygen;

means for transporting said groundwater between said well and said storing means; and means connected with said transporting means for sampling groundwater from said well.

11. The apparatus as recited in claim 10, wherein said transporting means comprises:

means for removing said groundwater from said well to said storing means; and means for returning said groundwater from said storing means to said well.

12. The apparatus as recited in claim 10, wherein said transporting means further comprises:

a conduit;

means for controlling said groundwater flowing through said conduit; and a pump for pumping said groundwater through said conduit.

13. The apparatus as recited in claim 10, wherein said transporting means comprises a pump adapted to be submerged in said groundwater of said well.

14. The apparatus as recited in claim 10, further comprising a frame to support said storing means.

15. The apparatus as recited in claim 10, wherein said storing means is capable of storing the required number of well volumes of groundwater.

16. The apparatus as recited in claim 10, wherein said storing means comprises an expandable container.

17. A method of obtaining a fluid sample from a groundwater monitoring well, said method comprising the steps of:

transporting a predetermined quantity of said groundwater from said well into a container having an interior and that expands to receive said groundwater into said interior so that said groundwater does not come into contact with air;

obtaining a sample of said groundwater from said well; and returning said predetermined quantity of groundwater from within said expandable container to said well.

18. The method as defined in claim 17, wherein the returning step further comprises returning said predetermined quantity of groundwater from within said interior of said expandable container to said well so that said groundwater does not come into contact with air.

19. The method as defined in claim 17, further comprising the step of connecting said well with said expandable container so that said well is in fluid communication with said interior of said expandable container and not in contact with air.

20. The method as defined in claim 17, wherein said well has a volume and further comprising the step of pumping at least one volume of groundwater contained in said well from said well to said expandable container.

* * * * *